US010321774B2

(12) United States Patent
Sherman et al.

(10) Patent No.: US 10,321,774 B2
(45) Date of Patent: Jun. 18, 2019

(54) MATTRESS SHEET AND PROTECTOR

(71) Applicants: Philip R. Sherman, Melville, NY (US); Philip W. McCarty, Natick, MA (US)

(72) Inventors: Philip R. Sherman, Melville, NY (US); Philip W. McCarty, Natick, MA (US)

(73) Assignee: PPJ, LLC, Natick, MA (US)

( * ) Notice: Subject to any disclaimer, the term of this patent is extended or adjusted under 35 U.S.C. 154(b) by 387 days.

(21) Appl. No.: 15/220,074

(22) Filed: Jul. 26, 2016

(65) Prior Publication Data

US 2018/0028000 A1 Feb. 1, 2018

(51) Int. Cl.
*A47G 9/02* (2006.01)
*A47C 31/10* (2006.01)

(52) U.S. Cl.
CPC ..... *A47G 9/0246* (2013.01); *A47C 31/105* (2013.01)

(58) Field of Classification Search
CPC ..... A47G 9/02
USPC ..... 5/497–499, 482
See application file for complete search history.

(56) References Cited

U.S. PATENT DOCUMENTS 4,893,365 A 1/1990 Justice
7,389,554 B1 6/2008 Rose
8,973,183 B1 3/2015 Palashewski et al.
2009/0106901 A1* 4/2009 Wootten, Jr. ..... A47G 9/0246 5/497
2013/0239328 A1* 9/2013 Rose ..... A47G 9/0246 5/497
2015/0182397 A1* 7/2015 Palashewski ..... A47C 20/041 5/616
2015/0182399 A1 7/2015 Rose et al.
2015/0290059 A1 10/2015 Brosnan et al.

FOREIGN PATENT DOCUMENTS

EP 1 867 255 A1 12/2007

* cited by examiner

*Primary Examiner* — Fredrick C Conley
(74) *Attorney, Agent, or Firm* — Patent Portfolio Builders PLLC

(57) ABSTRACT

A mattress sheet includes a top sheet portion having a first end, a second end opposite the first end, a pair of opposing sides defining a mattress sheet width there between, a first end sheet split extending into the top sheet portion from the first end to define first end sheet split edges and two separate first end sections and a second end sheet split extending into the top sheet portion from the second end to define second end sheet split edges and two separate second end sections. A fabric border has a top edge running along the first end, the first end sheet split edges, the opposing sides, the second end and the second end sheet split edges and a bottom edge opposite the top edge. A fabric extension extends from the fabric border a distance less than about the mattress sheet width.

20 Claims, 6 Drawing Sheets

MATTRESS SHEET AND PROTECTOR

TECHNICAL FIELD

Embodiments of the subject matter disclosed herein relate to bedding and in particular to mattress sheets and mattress protectors for use with adjustable, articulating bed foundations and frames.

BACKGROUND

Adjustable or articulating beds provide selectable adjustment of the lower or foot portion and upper or head portion of a mattress from a traditional flat or horizontal position. Therefore, the head or foot of a user can be elevated as desired, for example, for comfort, to provide relief from snoring or to facilitate reading. The upper and lower portions are adjustable independent of each other. Adjustment is provided by an articulating foundation that is mounted on a frame and that supports a mattress.

While a twin-sized adjustable bed is arranged for a single user, larger beds such as full-sized, queen-sized and king-sized adjustable beds are arranged to fit two users, one on either side of the bed. The adjustable beds for these larger bed sizes can be configured to provide separate upper and lower portion adjustment for each side of the bed. Separate adjustment, however, would not work with a single mattress. Two separate twin mattresses could be used for king-sized bed frames. However, the use of two separate mattresses may not be comfortable, and separate mattresses are not an option for queen-sized and full-sized adjustable beds.

A solution that has been proposed is the use of a single mattress that provides for separate movement of the head and foot sections of either side of the mattress using a split down the middle of the mattress from either end. These splits do not pass completely along the length of the mattress and do not overlap, leaving a central portion of the mattress that does not contain a split and that extends the entire width of the mattress. This defines an "H" shape or butterfly shape in the mattress.

Conventional bedding products such as fitted and flat sheets and mattress protectors are configured to work with conventional rectangular mattresses. These convention products do not accommodate mattresses that have split head and foot portions. Therefore, improved mattress sheets and mattress protectors are desired that work with split mattresses and that provide for relative movement between the separate split portions of the mattress.

SUMMARY

Embodiments are directed to mattress sheets and mattress protectors for covering mattresses including mattresses configured for use with adjustable bed systems including adjustable bed systems where the upper or head section, i.e., a split top section, and the lower or foot section, i.e., a split foot section, of the mattress provide for independent articulating or adjustable movement of either side of the mattress. The mattress sheet can be used with full-sized, queen-sized and king-sized adjustable bed frames. While the mattress sheet can have a conventional rectangular shape, in one embodiment, the mattress sheet has an "H" or butterfly appearance when view from the top sheet portion of the mattress sheet. Therefore, the mattress sheet facilitates independent adjustability when using a bed frame with two adjustable base foundations, e.g., two twin XL foundations. The central portion of the mattress sheet is a single piece spanning an entire width of the mattress.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
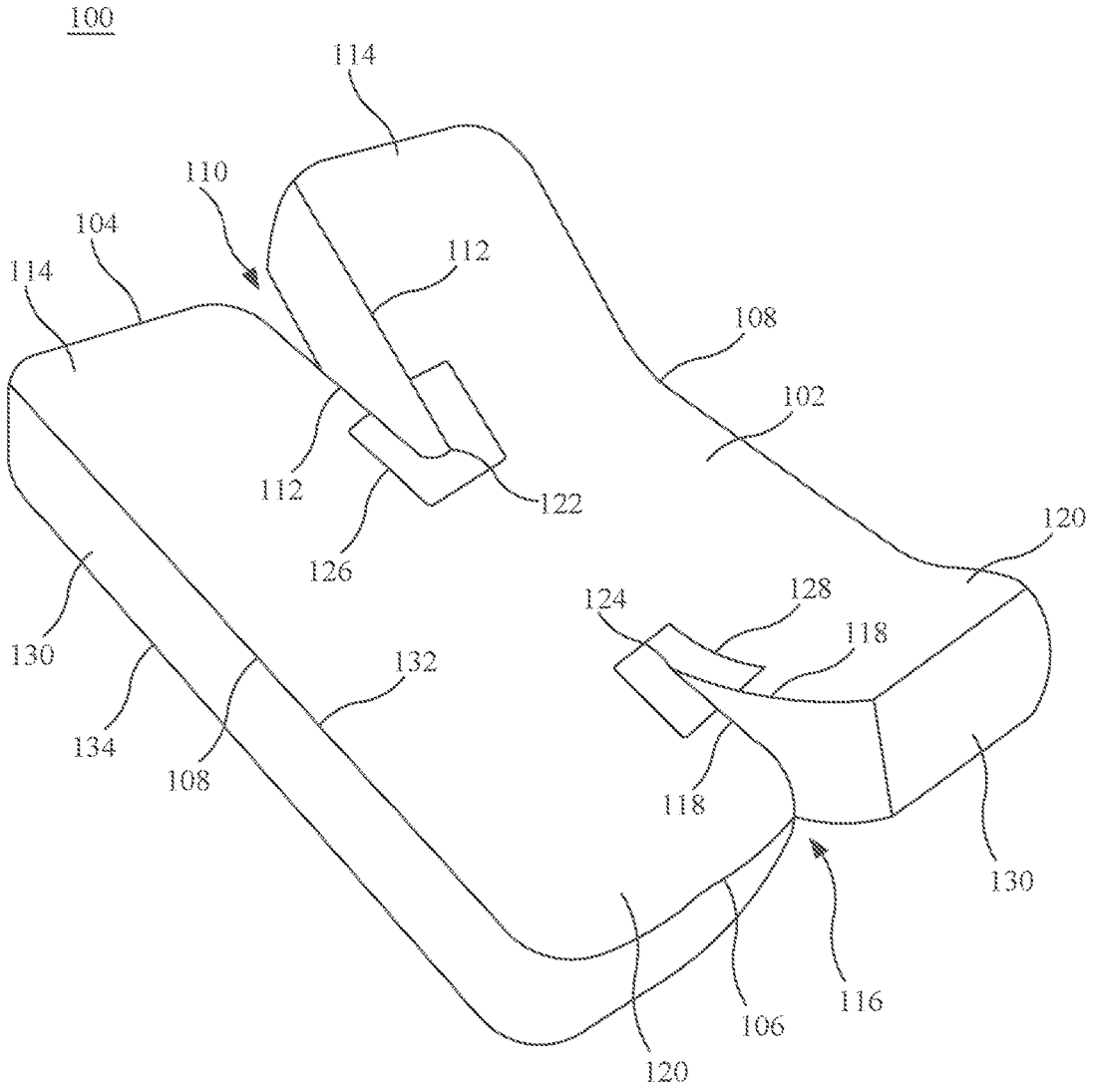
FIG. 1 is a top perspective view of an embodiment of a mattress sheet in accordance with the present invention.

Referring initially to FIG. 1, exemplary embodiments are directed to a mattress sheet 100 or mattress protector sized and shaped to fit a variety of mattress widths, lengths and thicknesses. These widths, lengths and thicknesses encompass twin size mattresses, full size mattress, queen size mattresses and king size mattresses. The mattress sheet can be used with mattresses on conventional fixed or stationary bedding foundations and frames or with adjustable or articulating bedding foundations. Suitable types of mattresses include foam mattresses, spring mattresses and air component mattress systems. In one embodiment, the mattress sheet is configured to accommodate mattresses that include one or more splits that pass completely through the thickness of the mattress and that extend into the mattress from one or more ends or sides of the mattress. The splits define multiple portions of the mattress at either the head end or foot end of the mattress, and these multiple portions provide for independent articulation or adjustment of each portion of the mattress. These mattresses, and therefore, the mattress sheet have an "H" or "Butterfly" shape when viewed from the top of the mattress or mattress sheet.

In one embodiment, the mattress sheet 100 includes a top sheet portion 102. Suitable materials for the top sheet portion include, but are not limited to, fabrics including cotton fabrics, synthetic fabrics, quilted fabrics, plastics and combinations thereof. The top sheet portion is the portion of the sheet that covers the top of the mattress. Therefore, the top sheet portion is in contact with the user of the mattress and mattress sheet. The top sheet portion includes a first end or head end 104 and a second end or foot end 106 opposite the first end. The mattress sheet also includes a pair of opposing sides 108 extending between the first and second ends on either side of the mattress sheet. A first end sheet split 110 is provided in the mattress sheet. The first end sheet split extends into the top sheet portion from the first end and defines first end sheet split edges 112, i.e., two first end sheet split edges, one each on either side of the first end sheet split. The first end sheet split also defines two separate first end sections 114. Each first end section extends between one of the first end sheet split edges and one of the opposing sides.

In one embodiment, a second end sheet split 116 is provided in the mattress sheet. The second send sheet split extends into the top sheet portion from the second end and defines second end sheet split edges 118, i.e., two second end sheet split edges, one each on either side of the second end sheet split. The second end sheet split also defines two separate second end sections 120. Each second end section extends between one of the second end sheet split edges and one of the opposing sides. Therefore, in one embodiment, the mattress sheet is configured to be used with mattress that provide for articulation of two separate first end sections and two separate second end sections.

In one embodiment, the first end sheet split extends into the top sheet portion to a first termination point 122, and the second end sheet split extends into the top sheet portion to a second termination point 124. Since the two separate first end sections and the two separate second end sections are configured to move relative to each other, the first and second termination points represent stress points in the mattress sheet. Stress points in the mattress sheet can result in tears or holes appearing in the mattress sheet as a result of repeated adjustments to the position of the mattress covered by the mattress sheet. Therefore, the mattress sheet further includes a first reinforcing gusset 126 and a separate second reinforcing gusset 128 each covering only a portion of the top sheet portion adjacent the first and second termination points respectively. In one embodiment, the first reinforcing gusset extends over the top sheet portion from the first termination point toward the second end, over the top sheet portion from each one of the first end sheet split edges towards one of the opposing sides and along each one of the first end sheet split edges from the first termination point. Similarly, the second reinforcing gusset extends over the top sheet portion from the second termination point toward the first end, over the top sheet portion from each one of the second end sheet split edges towards one of the opposing sides and along each one of the second end sheet split edges from the second termination point.

As illustrated, the first and second reinforcing gussets are generally rectangular in shape; however, other shapes can be used including triangular, circular and oblong shapes. In one embodiment, each one of the first and second reinforcing gussets are pieces of material that are separate from the top sheet portion, that are placed over the top sheet portion and that are attached to the top sheet portion using any suitable method for attaching material together that are known and available in the art including using stitching methods and sewing with a serger. Suitable materials for the first and second reinforcing gussets include, but are not limited to, the same material as the top sheet portion and stretchable fabric materials such as a spandex material.

The mattress sheet also includes a fabric border 130. Suitable materials for the fabric border include, but are not limited to, fabrics including cotton fabrics, synthetic fabrics, quilted fabrics, plastics and combinations thereof. The fabric border can be constructed from a single continuous sheet of material or from two or more individual sheets of material that are connected or stitched together. The fabric border includes a top edge 132 that is in contact with and extends along the first end, the first end sheet split edges, the opposing sides, the second end and the second end sheet split edges. Therefore, the fabric border extends completely around the top sheet portion. The fabric border also includes a bottom edge 134 opposite the top edge. In one embodiment, the bottom edge includes an elastic band to hold the mattress sheet on the mattress in a fitted arrangement. While illustrated as a separate piece of material that is attached to the top sheet portion, in one embodiment, the fabric border, or at least a portion of the fabric border is formed integral with or as an extension of the top sheet portion.

Figure 2:
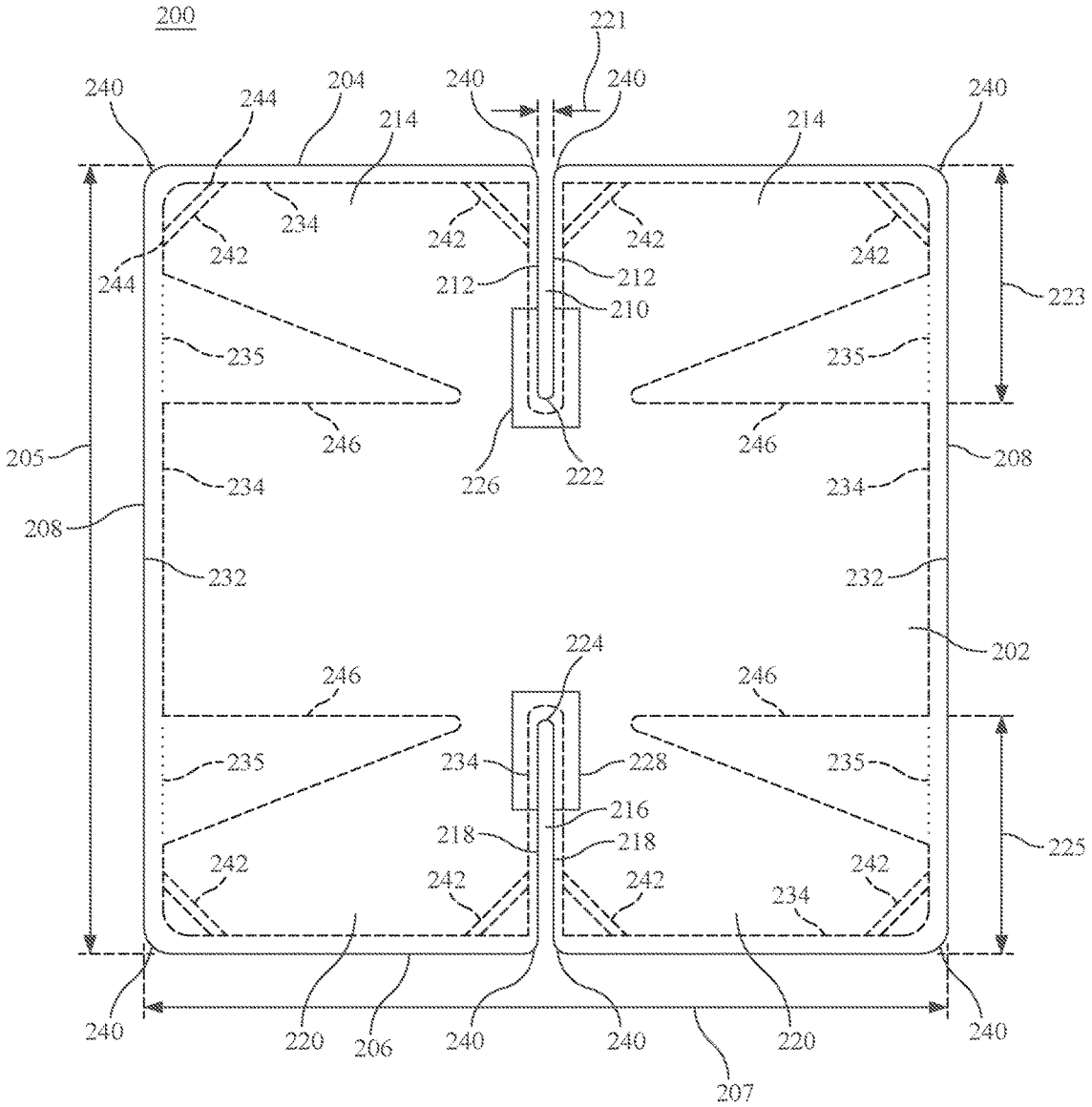
FIG. 2 is a schematic representation of the top of an embodiment of the mattress sheet.
Figure 3:
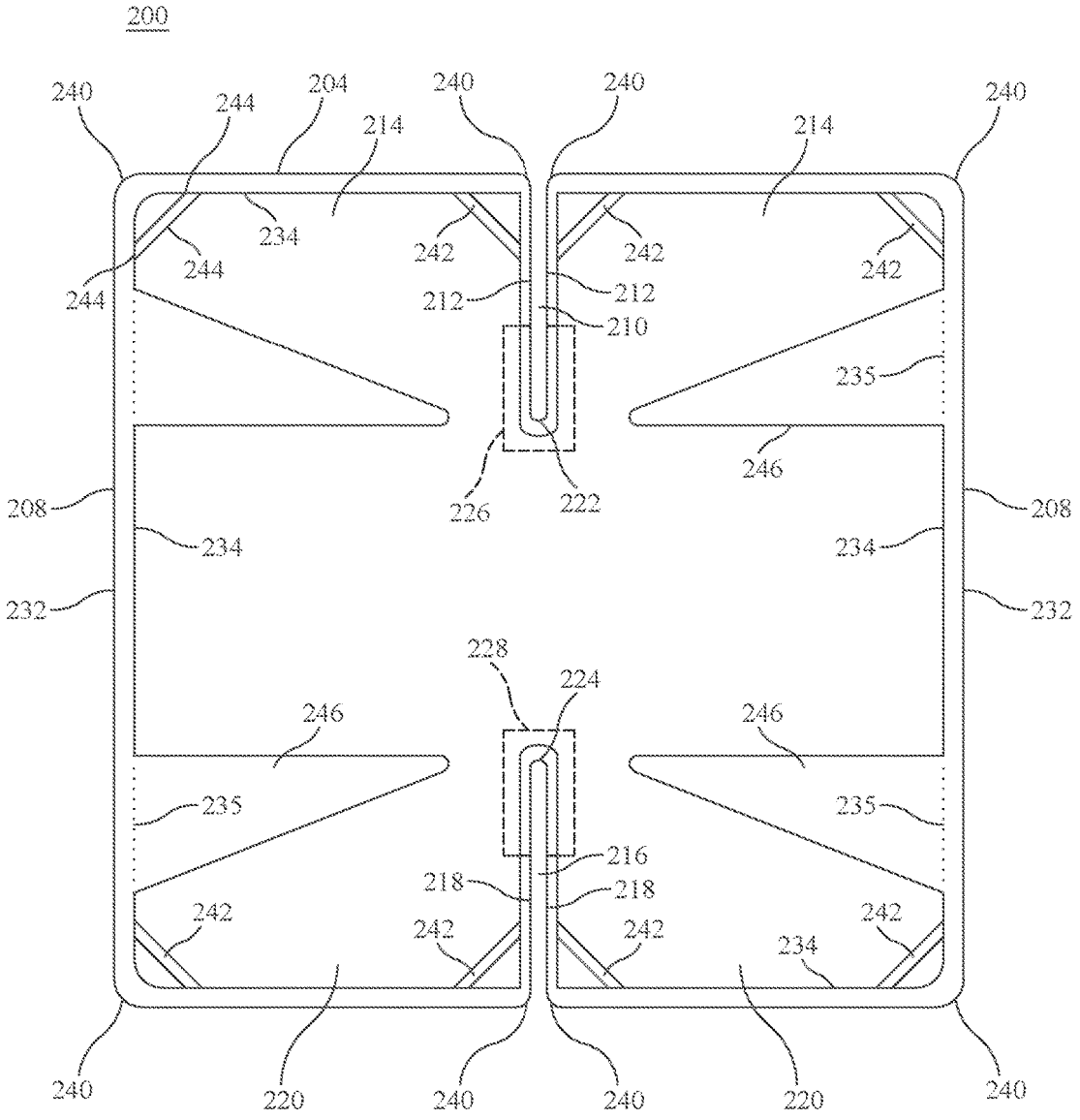
FIG. 3 is a schematic representation of the bottom of the embodiment of the mattress sheet.

Referring to FIGS. 2 and 3, an embodiment of the mattress sheet 200 is illustrated that includes a top sheet portion 202. The top sheet portion includes a first end or head end 204 and a second end or foot end 206 opposite the first end. The first and second ends define a mattress sheet length 205 there between. The mattress sheet also includes a pair of opposing sides 208 extending between the first and second ends on either side of the mattress sheet. The opposing sides define a mattress sheet width 207 there between.

A first end sheet split 210 is provided in the mattress sheet. The first end sheet split extends into the top sheet portion from the first end and defines first end sheet split edges 212, i.e., two first end sheet split edges, one each on either side of the first end sheet split. The first end sheet split also defines two separate first end sections 214. Each first end section extends between one of the first end sheet split edges and one of the opposing sides. In one embodiment, a second end sheet split 216 is provided in the mattress sheet. The second send sheet split extends into the top sheet portion from the second end and defines second end sheet split edges 218, i.e., two second end sheet split edges, one each on either side of the second end sheet split. The second end sheet split also defines two separate second end sections 220. Both the first end sheet split edges and the second end sheet split edges are separate by a split width 221. Suitable split widths are up to about 1 inch, preferably up to about 0.5 inches. In one embodiment, the split width is about 0.5 inches. The split width prevents the mattress sheet from binding, gathering or rubbing within the split. The split width can be constant along its length or can vary along the length of each end split.

In one embodiment, the first end sheet split extends into the top sheet portion a first depth 223 to a first termination point 222, and the second end sheet split extends into the top sheet portion a second depth 225 to a second termination point 224. In one embodiment, the first depth is the same as the second depth. Alternatively, the first depth is different than the second depth. Suitable first and second depths are from about 24 inches up to about 30 inches. Preferably, each depth is about 27 inches.

The mattress sheet includes a first reinforcing gusset 226 and a separate second reinforcing gusset 228 each covering only a portion of the top sheet portion adjacent the first and second termination points respectively. In one embodiment, the first reinforcing gusset extends over the top sheet portion from the first termination point toward the second end, over the top sheet portion from each one of the first end sheet split edges towards one of the opposing sides and along each one of the first end sheet split edges from the first termination point. In one embodiment, the first reinforcing gusset extends along each one of the first end sheet split edges from the first termination point only a portion of the first depth. Similarly, the second reinforcing gusset extends over the top sheet portion from the second termination point toward the first end, over the top sheet portion from each one of the second end sheet split edges towards one of the opposing sides and along each one of the second end sheet split edges from the second termination point. In one embodiment, the second reinforcing gusset extends along each one of the second end sheet split edges from the second termination point only a portion of the second depth.

As illustrated, the first and second reinforcing gussets are generally rectangular in shaped; however, other shapes can be used include rectangular, circular and oblong shapes. Each one of the first and second reinforcing gussets are pieces of material that are separate from the top sheet portion, that are placed over the top sheet portion and that are attached to the top sheet portion using any suitable method for attaching material together that are known and available in the art including using stitching methods and sewing using a serger. Suitable materials for the first and second reinforcing gussets include, but are not limited to, that same material as the top sheet portion and stretchable fabric materials such as a spandex material.

As was discussed above, the mattress sheet also includes a fabric border having a top edge 232 that is in contact with and extends along the first end, the first end sheet split edges, the opposing sides, the second end and the second end sheet split edges. The fabric border also includes a bottom edge 234 opposite the top edge. In one embodiment, the bottom edge includes one or more elastic bands running along the bottom edge to hold the mattress sheet on the mattress in a fitted arrangement.

The mattress sheet includes at least one fabric extension 246 extending from the mattress sheet a distance less than the mattress sheet width. In one embodiment, the distance is less than about half the mattress sheet width; therefore, the fabric extension can be positioned within one of the first end sections or second end sections. In one embodiment, the fabric extension extends from the top sheet portion. Alternatively, the fabric extension extends from the fabric border, and in particular from the bottom edge 234 of the fabric border. In one embodiment, the portion of the bottom edge from which the fabric extension extends is opposite a portion of the top edge in contact with one of the opposing sides of the top sheet portion. The fabric extension extends along the bottom edge a distance that is less than the mattress sheet length. In one embodiment, the portion of the bottom edge along which the fabric extension extends is less than half the mattress sheet length.

In one embodiment, the fabric extension is formed integral with the fabric border. Alternatively, the fabric extension is separate from and attached to the fabric border, for example, along one or more stitched lines 235. In one embodiment, the fabric extension has a triangular shape. Suitable materials for the fabric extension include, but are not limited to, fabrics including cotton fabrics, synthetic fabrics, quilted fabrics, rubberized fabrics, plastics and combinations thereof.

In general, the fabric extension is configured to be positioned between the mattress on which the mattress sheet is attached and the foundation or frame on which the mattress is placed. Therefore, the fabric extension helps to secure or hold the mattress sheet on the mattress, even when one or more ends or end portions of the mattress are moved or articulated by an adjustable foundation. In one embodiment, the mattress sheet includes two fabric extensions extending from the mattress sheet on opposite sides of the mattress sheet. Therefore, each fabric extension can be position under one of the first end portions or one of the second end portions. Alternatively, the mattress sheet includes four fabric extensions, with two fabric extensions extending from each side of the mattress sheet. When the mattress sheet includes two or four fabric extensions, the fabric extensions are in contact with and run along separate portions of the bottom edge of the fabric border, either on the same side or on opposite sides of the mattress sheet. Each separate portion of the bottom edge is opposite a portion of the top edge of the fabric border that is in contact with one of the opposite sides of the top sheet portion.

Figure 4:
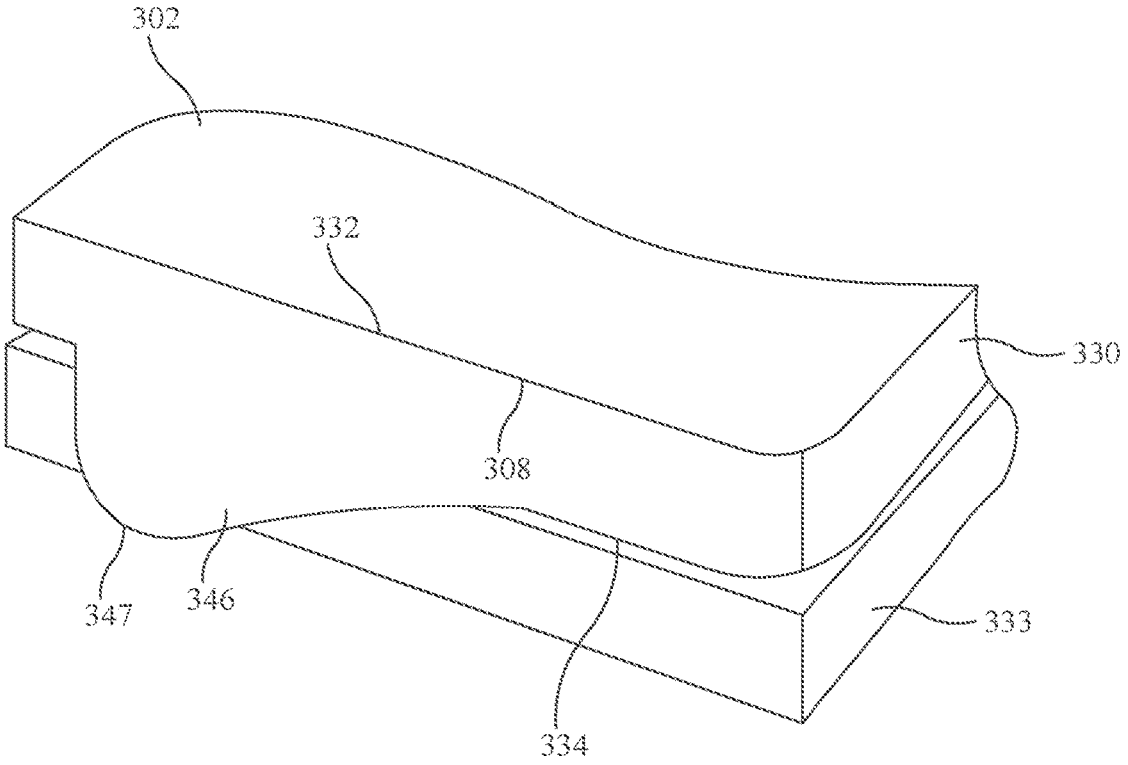
FIG. 4 is partial perspective view of an embodiment of a mattress sheet with fabric extension.

Referring to FIG. 4, an embodiment of a fabric extension 346 is illustrated in which a single fabric extension on a given side 308 of the top sheet portion 302 extends from the bottom edge 384 of the fabric border 330 opposite the top edge 332. The fabric extension is formed integral with the fabric border and extends along the fabric border only a portion of the mattress sheet length. The fabric extension is folded under the mattress to be positioned between the mattress and the foundation 333 holding the mattress. The fabric extension has a generally triangular shape with a rounded apex 347.

Returning to FIGS. 2 and 3, the mattress sheet includes a plurality of corners 240 corresponding to the corners of the mattress that the mattress sheet covers. Suitable numbers of corners include four, six and eight corners. As used herein, a given corner refers to the corner at both the top face and the bottom face of the mattress. In one embodiment, the first end, the first end sheet split edges, the opposing sides, the second end and the second end sheet split edges define eight corners 240 in the mattress sheet. The mattress sheet further includes eight elastic straps 242. Each elastic strap is disposed diagonally across each one eight corners and passes under the mattress opposite the top side portion of the mattress sheet. While each elastic strap can be attached directly to the top sheet portion of the mattress sheet, preferably, each elastic strap is attached to the bottom edge of the fabric border. In one embodiment, each elastic strap has two ends 244, and each end of each elastic strap is attached to the bottom edge of the fabric border on opposite sides of a given corner. Any suitable elastic material known and available in the art can be used for the elastic straps. In one embodiment, each elastic strap has a width of from about 2 inches to about 4 inches.

Figure 5:
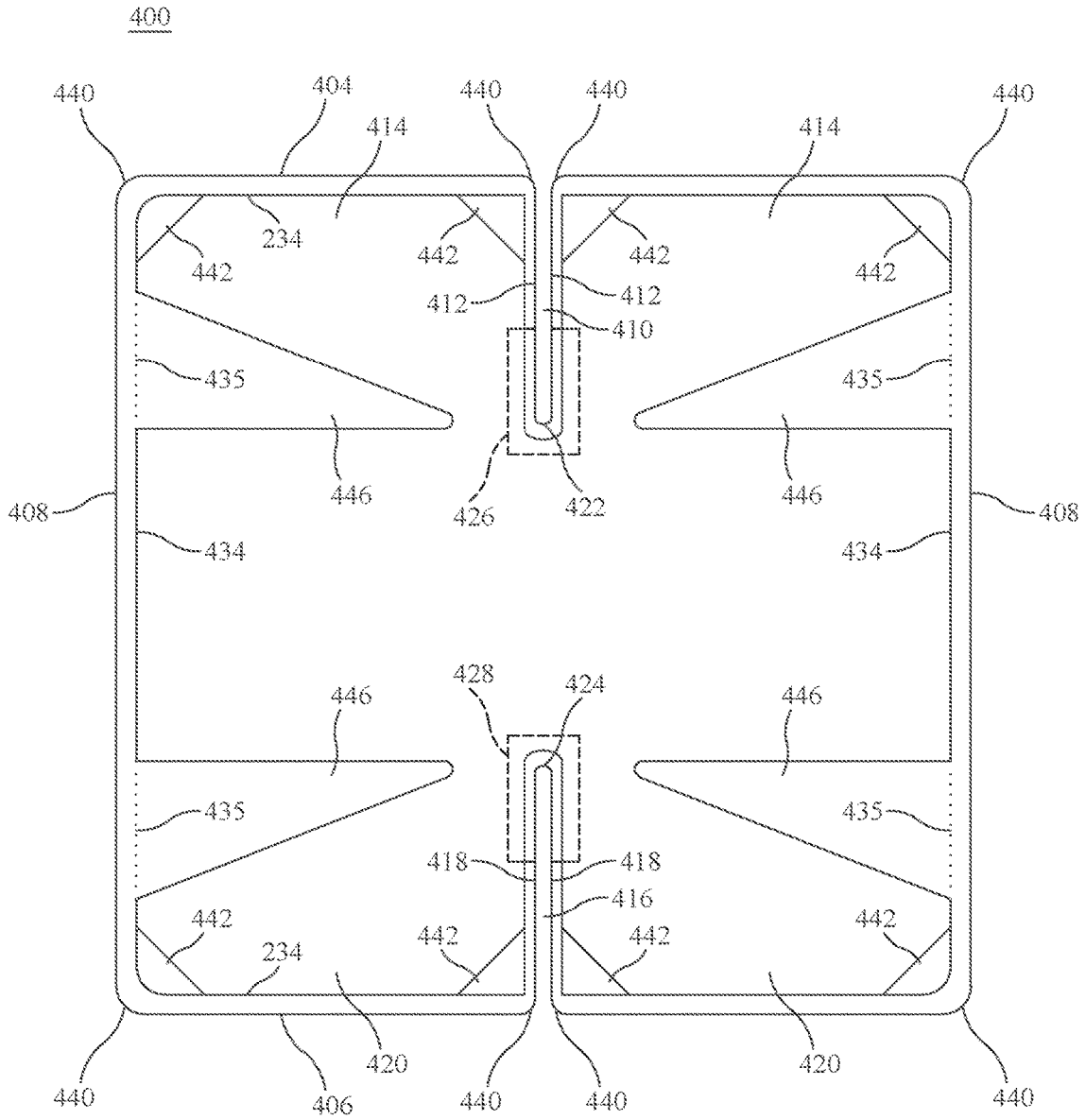
FIG. 5 is schematic representation of the bottom of another embodiment of the mattress sheet.

Referring now to FIG. 5, an embodiment of the mattress sheet 400 is illustrated that includes a top sheet portion. The top sheet portion includes a first end or head end 404 and a second end or foot end 406 opposite the first end. The mattress sheet also includes a pair of opposing sides 408 extending between the first and second ends on either side of the mattress sheet. A first end sheet split 410 is provided in the mattress sheet. The first end sheet split extends into the top sheet portion from the first end and defines first end sheet split edges 412, i.e., two first end sheet split edges, one each on either side of the first end sheet split. The first end sheet split also defines two separate first end sections 414. Each first end section extends between one of the first end sheet split edges and one of the opposing sides. In one embodiment, a second end sheet split 416 is provided in the mattress sheet. The second send sheet split extends into the top sheet portion from the second end and defines second end sheet split edges 418, i.e., two second end sheet split edges, one each on either side of the second end sheet split. The second end sheet split also defines two separate second end sections 420.

In one embodiment, the first end sheet split extends into the top sheet portion to a first termination point 422, and the second end sheet split extends into the top sheet portion to a second termination point 424. The mattress sheet includes a first reinforcing gusset 426 and a separate second reinforcing gusset 428 each covering only a portion of the top sheet portion adjacent the first and second termination points respectively. In one embodiment, the first reinforcing gusset extends over the top sheet portion from the first termination point toward the second end, over the top sheet portion from each one of the first end sheet split edges towards one of the opposing sides and along each one of the first end sheet split edges from the first termination point. Similarly, the second reinforcing gusset extends over the top sheet portion from the second termination point toward the first end, over the top sheet portion from each one of the second end sheet split edges towards one of the opposing sides and along each one of the second end sheet split edges from the second termination point.

As was discussed above, the mattress sheet also includes a fabric border having a top edge that is in contact with and extends along the first end, the first end sheet split edges, the opposing sides, the second end and the second end sheet split edges. The fabric border also includes a bottom edge 434 opposite the top edge. In one embodiment, the bottom edge includes an elastic band to hold the mattress sheet on the mattress in a fitted arrangement. The mattress sheet includes at least one fabric extension 446 extending from the mattress sheet a distance less than the mattress sheet width. In one embodiment, the distance is less than about half the mattress sheet width; therefore, the fabric extension can be positioned within one of the first end sections of second end sections. In one embodiment, the fabric extension extends from the top sheet portion. Alternatively, the fabric extension extends from the fabric border, and in particular from the bottom edge 434 of the fabric border. In one embodiment, the portion of the bottom edge from which the fabric extension extends is opposite a portion of the top edge in contact with one of the opposing sides of the top sheet portion. The fabric extension extends along the bottom edge a distance that is less than the mattress sheet length. In one embodiment, the portion of the bottom edge along which the fabric extension extends is less than half the mattress sheet length.

In one embodiment, the fabric extension is formed integral with the fabric border. Alternatively, the fabric extension is separate from and attached to the fabric border, for example, along one or more stitched lines 435 or lines sewed using a serger. In one embodiment, the fabric extension has a triangular shape. Suitable materials for the fabric extension include, but are not limited to, fabrics including cotton fabrics, synthetic fabrics, quilted fabrics, rubberized fabrics, plastics and combinations thereof.

In general, the fabric extension is configured to be positioned between the mattress on which the mattress sheet is attached and the foundation or frame on which the mattress is placed. Therefore, the fabric extension helps to secure or hold the mattress sheet on the mattress, even when one or more ends or end portions of the mattress are moved or articulated by an adjustable foundation. In one embodiment, the mattress sheet includes two fabric extensions extending from the mattress sheet on opposite sides of the mattress sheet. Therefore, each fabric extension can be position under one of the first end portions or one of the second end portions. Alternatively, the mattress sheet includes four fabric extensions, with two fabric extensions extending from each side of the fabric extension. When the mattress sheet includes two or four fabric extensions, the fabric extensions are in contact with and run along separate portions of the bottom edge, either on the same side or on opposite sides of the mattress sheet. Each separate portion of the bottom edge is opposite a portion of the top edge of the fabric border that is in contact with one of the opposite sides of the top sheet portion.

The mattress sheet includes a plurality of corners 440 corresponding to the corners of the mattress that the mattress sheet covers. Suitable numbers of corners include four, six and eight corners. In one embodiment, the first end, the first end sheet split edges, the opposing sides, the second end and the second end sheet split edges define eight corners 440 in the mattress sheet. The mattress sheet includes eight corner gussets 442. Each corner gusset is disposed in one of the eight corners and is in contact with the bottom edge 434 of the fabric border, extending from one side of the corner, through the corner to the other side of the corner. Therefore, each corner gusset fills a given corner with material and forms a corner pocket with the fabric border and the top sheet portion. The corresponding corner of the mattress is disposed within this corner pocket between the top sheet portion and the corner gusset. Suitable materials for the corner gussets include, but are not limited to, a rubberized mesh material.

Figure 6:
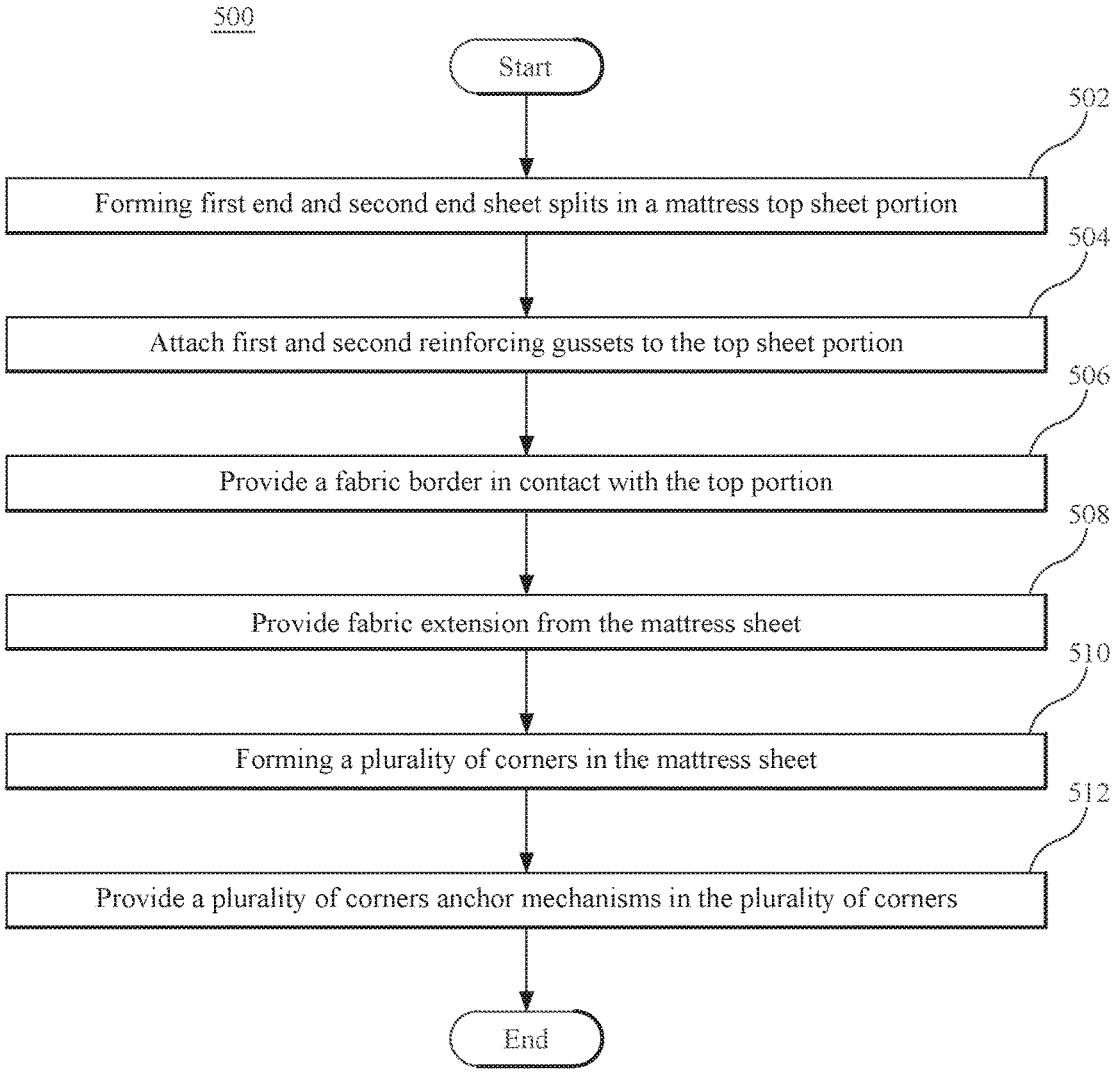
FIG. 6 is flow chart illustrating an embodiment of a method for making the mattress sheet.

Referring to FIG. 6, exemplary embodiments are also directed to a method for making the mattress sheet 500. First end and second end sheet splits are formed in a top sheet portion of the mattress sheet 502. The top sheet portion includes a first end, a second end opposite the first end and a pair of opposing sides extending between the first and second ends on either side of the mattress sheet. The first end sheet split extends into the top sheet portion from the first end and defines first end sheet split edges, one each on either side of the first end sheet split. The first end sheet split also defines two separate first end sections. Each first end section extends between one of the first end sheet split edges and one of the opposing sides. The second end sheet split extends into the top sheet portion from the second end and defines second end sheet split edges, one each on either side of the second end sheet split. The second end sheet split also defines two separate second end sections.

In one embodiment, forming the first end sheet split includes extending the first end sheet split into the top sheet portion a first depth to a first termination point, and forming the second end sheet split includes extending the second end sheet split into the top sheet portion a second depth to a second termination point. First and second reinforcing gussets are attached to the mattress sheet on the top sheet portion 504. Each reinforcing gusset covers only a portion of the top sheet portion adjacent the first and second termination points respectively. In one embodiment, attaching the first reinforcing gusset includes sizing the first reinforcing gusset to extend over the top sheet portion from the first termination point toward the second end, over the top sheet portion from each one of the first end sheet split edges towards one of the opposing sides and along each one of the first end sheet split edges from the first termination point. In one embodiment, the first reinforcing gusset extends along each one of the first end sheet split edges from the first termination point only a portion of the first depth. Similarly, attaching the second reinforcing gusset includes sizing the second reinforcing gusset to extend over the top sheet portion from the second termination point toward the first end, over the top sheet portion from each one of the second end sheet split edges towards one of the opposing sides and along each one of the second end sheet split edges from the second termination point. In one embodiment, the second reinforcing gusset extends along each one of the second end sheet split edges from the second termination point only a portion of the second depth. Suitable methods for attaching the first and second reinforcing gussets include, but are not limited to, using stitching and sewing using a serger. Suitable materials for the first and second reinforcing gussets include, but are not limited to, stretchable fabric materials such as a spandex material.

A fabric border is provided in contact with the top sheet portion 506. In one embodiment, providing the fabric border includes attaching the fabric border along the first end, the first end sheet split edges, the opposing sides, the second end and the second end sheet split edges of the top sheet portion. In one embodiment, the fabric border is provided with a top edge and a bottom edge opposite the top edge. Attaching the fabric border to the top sheet portion includes attaching the top edge along the fabric border along the first end, the first end sheet split edges, the opposing sides, the second end and the second end sheet split edges of the top sheet portion. Suitable methods for attaching the fabric border to the top sheet portion include, but are not limited to, using stitching and sewing with a serger. In one embodiment, the method includes providing an elastic band in the bottom edge of the fabric border to hold the mattress sheet on the mattress in a fitted arrangement.

The method includes providing at least one fabric extension extending from the mattress sheet 506. In one embodiment, providing the fabric extension includes providing two fabric extensions extending from the mattress sheet on opposite sides of the mattress sheet. Alternatively, providing the fabric extension includes providing four fabric extensions extending from the mattress sheet, with two fabric extensions extending from each side of the fabric extension. In one embodiment, providing the two or four fabric extensions includes providing the fabric extensions in contact with and along separate portions of the bottom edge of the fabric border, either on the same side or on opposite sides of the mattress sheet. Each separate portion of the bottom edge is opposite a portion of the top edge of the fabric border that is in contact with one of the opposite sides of the top sheet portion.

In one embodiment, the method includes sizing the fabric extension to extend across the mattress sheet a distance less than the mattress sheet width. In one embodiment, the method includes sizing the fabric extension to extend across the mattress sheet a distance is less than about half the mattress sheet width. In one embodiment, the method includes attaching the fabric extension directly to the top sheet portion. Alternatively, the method includes attaching the fabric extension to the fabric border, and in particular to the bottom edge of the fabric border. In one embodiment, attaching the fabric extension includes forming the fabric extension integral with the fabric border. Alternatively, the fabric extension is separate from and attached to the fabric border, and the method includes attaching the fabric extension to the fabric border. Suitable methods for attaching the fabric extension include, but are not limited to, using stitching and sewing using a serger. In one embodiment, the method includes forming the fabric extension as a triangular shape. Suitable materials for the fabric extension include, but are not limited to, fabrics including cotton fabrics, synthetic fabrics, quilted fabrics, rubberized fabrics, plastics and combinations thereof.

As discussed herein, the mattress sheet includes a plurality of corners corresponding to the corners of the mattress that the mattress sheet covers. Suitable numbers of corners include four, six and eight corners. As used herein, a given corner refers to the corner at both the top face and the bottom face of the mattress. In one embodiment, the first end, the first end sheet split edges, the opposing sides, the second end and the second end sheet split edges define eight corners in the mattress sheet. In one embodiment, the method includes providing a plurality of corner anchor mechanisms in the plurality of corners 512. The corner anchor mechanism is configured to anchor the corners of the mattress sheet to the mattress. A corner anchor mechanism can be placed in each one of the plurality of corners. Alternatively, a corner anchor mechanism is placed in on a portion of the plurality of corners. In one embodiment, providing the plurality of corner anchor mechanisms includes providing a plurality, e.g., four or eight, elastic straps in the plurality of corners. Each elastic strap is disposed diagonally across each one eight corners. In one embodiment, providing the elastic straps includes attaching each elastic strap directly to the top sheet portion of the mattress sheet. Alternatively, providing the elastic straps includes attaching each elastic strap to the bottom edge of the fabric border. In one embodiment, each elastic strap has two ends, and attaching each elastic strap to the bottom edge includes attaching each elastic strap to the bottom edge of the fabric border on opposite sides of a given corner. Any suitable elastic material known and available in the art can be used for the elastic straps. In one embodiment, each elastic strap has a width of from about 2 inches to about 4 inches.

In one embodiment, providing the plurality of corner anchor mechanisms includes providing a plurality, e.g., four or eight, corner gussets in the plurality of corners. In one embodiment, providing the plurality of corner gussets includes providing each corner gusset in one of the eight corners in contact with the bottom edge of the fabric border such that the corner gusset extends from one side of the corner, through the corner to the other side of the corner. Therefore, providing the plurality of corner gussets includes filling a given corner with material and to form a corner pocket with the fabric border and the top sheet portion. The corresponding corner of the mattress is disposed within this corner pocket between the top sheet portion and the corner gusset. Suitable materials for the corner gussets include, but are not limited to, a rubberized mesh material.

Although the features and elements of the present exemplary embodiments are described in the embodiments in particular combinations, each feature or element can be used alone without the other features and elements of the embodiments or in various combinations with or without other features and elements disclosed herein. The methods or flowcharts provided in the present application may be implemented in a computer program, software, or firmware tangibly embodied in a computer-readable storage medium for execution by a dedicated computer or a processor.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A mattress sheet comprising:

a top sheet portion comprising:

a first end;

a second end opposite the first end, the first and second ends defining a mattress sheet length there between;

a pair of opposing sides defining a mattress sheet width there between;

a first end sheet split extending into the top sheet portion from the first end to define first end sheet split edges and two separate first end sections, each first end section extending between one of the first end sheet split edges and one of the opposing sides; and a second end sheet split extending into the top sheet portion from the second end to define second end sheet split edges and two separate second end sections, each second end section extending between one of the second end sheet split edges and one of the opposing sides;

a fabric border comprising:

a top edge in contact with and extending along the first end, the first end sheet split edges, the opposing sides, the second end and the second end sheet split edges; and a bottom edge opposite the top edge; and at least one fabric extension extending from and running along a portion of the bottom edge, the fabric extension extending from the fabric border a distance less than about the mattress sheet width.

2. The mattress sheet of claim 1, wherein the distance is less than about half the mattress sheet width.

3. The mattress sheet of claim 1, wherein the fabric extension comprises a triangular shape.

4. The mattress sheet of claim 1, wherein the portion of the bottom edge is less than the mattress sheet length.

5. The mattress sheet of claim 4, wherein the portion of the bottom edge extends less than half the mattress sheet length.

6. The mattress sheet of claim 1, further comprising two fabric extensions in contact with and running along separate portions of the bottom edge, each separate portion of the bottom edge opposite a portion of the top edge in contact with one of the opposite sides of the top sheet portion.

7. The mattress sheet of claim 1, wherein the first end sheet split and the second end sheet split comprise a width of about 0.5 inches.

8. The mattress sheet of claim 1, wherein the bottom edge of the fabric border comprises an elastic band.

9. The mattress sheet of claim 1, wherein:

the first end, the first end sheet split edges, the opposing sides, the second end and the second end sheet split edges define eight corners in the mattress sheet; and the mattress sheet further comprises eight elastic straps, each elastic strap disposed diagonally across each one eight corners.

10. The mattress sheet of claim 9, wherein each elastic strap comprises two ends, and each end of each elastic strap is attached to the bottom edge of the fabric border.

11. The mattress sheet of claim 1, wherein:

the first end, the first end sheet split edges, the opposing sides, the second end and the second end sheet split edges define eight corners in the mattress sheet; and the mattress sheet further comprises eight corner gussets, each corner gusset disposed in one of the eight corners, in contact with the bottom edge of the fabric border and forming a corner pocket with the fabric border and the top sheet portion.

12. The mattress sheet of claim 11, wherein each corner gusset comprises a rubberized mesh material.

13. The mattress sheet of claim 1, wherein:

the first end sheet split extends into the top sheet portion a first depth to a first termination point;

the second end sheet split extends into the top sheet portion a second depth to a second termination point; and the mattress sheet further comprises:

a first reinforcing gusset extending over the top sheet portion from the first termination point toward the second end, over the top sheet portion from each one of the first end sheet split edges towards one of the opposing sides and along each one of the first end sheet split edges from the first termination point only a portion of the first depth; and a second reinforcing gusset extending over the top sheet portion from the second termination point toward the first end, over the top sheet portion from each one of the second end sheet split edges towards one of the opposing sides and along each one of the second end sheet split edges from the second termination point only a portion of the second depth.

14. The mattress sheet of claim 13, wherein the first reinforcing gusset and the second reinforcing gusset comprise a spandex material.

15. A mattress sheet comprising:

a top sheet portion comprising:

a first end;

a second end opposite the first end;

a pair of opposing sides;

a first end sheet split extending into the top sheet portion from the first end to define first end sheet split edges; and a second end sheet split extending into the top sheet portion from the second end to define second end sheet split edges, the first end, the first end sheet split edges, the opposing sides, the second end and the second end sheet split edges defining eight corners in the mattress sheet;

a fabric border comprising:

a top edge in contact with and extending along the first end, the first end sheet split edges, the opposing sides, the second end and the second end sheet split edges; and a bottom edge opposite the top edge; and eight corner gussets, each corner gusset disposed in one of the eight corners, in contact with the bottom edge of the fabric border and forming a corner pocket with the fabric border and the top sheet portion.

16. The mattress sheet of claim 15, wherein each corner gusset comprises a rubberized mesh material.

17. A mattress sheet comprising:

a top sheet portion comprising:

a first end;

a second end opposite the first end;

a pair of opposing sides defining a mattress sheet width there between;

a first end sheet split extending into the top sheet portion from the first end a first depth to a first termination point, the first end sheet split defining first end sheet split edges; and a second end sheet split extending into the top sheet portion from the second end a second depth to a second termination point, the second end sheet split defining second end sheet split edges;

a first reinforcing gusset extending over the top sheet portion from the first termination point toward the second end, over the top sheet portion from each one of the first end sheet split edges towards one of the opposing sides and along each one of the first end sheet split edges from the first termination point only a portion of the first depth; and a second reinforcing gusset extending over the top sheet portion from the second termination point toward the first end, over the top sheet portion from each one of the second end sheet split edges towards one of the opposing sides and along each one of the second end sheet split edges from the second termination point only a portion of the second depth.

18. The mattress sheet of claim 17, wherein the first reinforcing gusset and the second reinforcing gusset comprise a spandex material.

19. The mattress sheet of claim 17, wherein:

the mattress sheet further comprises a fabric border comprising:

a top edge in contact with and extending along the first end, the first end sheet split edges, the opposing sides, the second end and the second end sheet split edges, the first end, the first end sheet split edges, the opposing sides, the second end and the second end sheet split edges defining eight corners in the mattress sheet;

a bottom edge opposite the top edge; and eight corner gussets, each corner gusset disposed in one of the eight corners, in contact with the bottom edge of the fabric border and forming a corner pocket with the fabric border and the top sheet portion.

20. The mattress sheet of claim 19, wherein each corner gusset comprises a rubberized mesh material.

* * * * *